United States Patent [19]

Fordyce

[11] Patent Number: 4,828,540

[45] Date of Patent: May 9, 1989

[54] FOLDING APPARATUS WITH ADJUSTABLE SWING CHUTE

[76] Inventor: Glenn B. Fordyce, 7595 Cave Rd., Hillsboro, Ohio 45133

[21] Appl. No.: 78,562

[22] Filed: Jul. 28, 1987

[51] Int. Cl.[4] ..... B65H 45/20

[52] U.S. Cl. ..... 493/414; 493/415

[58] Field of Search ..... 493/411, 412, 413, 414, 493/415

[56] References Cited

U.S. PATENT DOCUMENTS

| | | |
|---|---|---|
| 2,098,427 | 11/1937 | Menschner . |
| 3,124,350 | 3/1964 | Huffman . |
| 3,499,643 | 3/1970 | Biggar, Jr. . |
| 3,889,940 | 6/1975 | Jakob . |
| 3,912,252 | 10/1975 | Stephens . |
| 4,045,012 | 8/1977 | Jakob . |
| 4,151,985 | 5/1979 | Gladow . |
| 4,277,058 | 7/1981 | Biggar, III . |
| 4,332,581 | 6/1982 | Thompson . |
| 4,401,428 | 8/1983 | Thomas et al. . |
| 4,512,561 | 4/1985 | Ury . |

FOREIGN PATENT DOCUMENTS

| | | |
|---|---|---|
| 2312442 | 12/1976 | France . |
| 894791 | 4/1962 | United Kingdom . |
| 988080 | 4/1965 | United Kingdom . |

*Primary Examiner*—Frederick R. Schmidt
*Assistant Examiner*—Jack Lavinder
*Attorney, Agent, or Firm*—Wood, Herron & Evans

[57] ABSTRACT

A spiral zig-zag folding apparatus for folding a length of paper having longitudinally spaced, transversely oriented perforations includes a swing chute assembly having an upper chute pivotally mounted to a lower chute which guide the paper between opposed spiral folders for folding along adjacent perforations. The upper and lower chutes are driven by a single drive arm carried at one side of the apparatus frame by an eccentric cam which is adjustable to vary the stroke of the drive arm, and, in turn, the movement of the chutes. Each chute includes a pair of spaced blades formed with a foam core overwrapped with one or more layers of composite material.

13 Claims, 5 Drawing Sheets

FOLDING APPARATUS WITH ADJUSTABLE SWING CHUTE

FIELD OF THE INVENTION

This invention relates to folding apparatus, and, more particularly, to a zig-zag type folding apparatus for folding endless lengths of paper having longitudinally spaced, transversely oriented perforations which includes a swing chute whose stroke is adjustable to accommodate paper from different webs having the perforations located at different intervals therealong.

BACKGROUND OF THE INVENTION

High speed printing machines have been developed in recent years for printing data on computer paper, business forms and the like. The paper supplied to such printers is provided in webs of indeterminate length formed with longitudinally spaced, transversely oriented perforations. The paper is fed at high speeds from the web to the printer which prints the desired information on the individual sheets formed between adjacent perforations, and then discharges the printed sheets for further handling.

In order to convert the continuous length of paper from the printer into a form which can be handled and shipped, the paper must be folded along its perforations as it is discharged from the printer. One type of folding apparatus intended for use with high-speed printers is a spiral, zig-zag folder.

Spiral zig-zag folders include a series of rollers which receive the paper from the printer and guide it to a reciprocating swing chute mechanism. The swing chute is driven forwardly and rearwardly relative to the frame of the folder through a distance or throw which is equal to the distance between the longitudinally spaced, transverse perforations in the paper. At both the forward and rearward limit of the throw of the swing chute, a set of beaters or fingers engages the paper in the area of its perforations and forces it into contact with one or more rotating spirals. The spirals resemble a screw having threads which are spaced progressively closer together from top to bottom. The paper is forced by the beaters or fingers between the thread of the spirals which crease the paper along its perforations. The paper is then discharged from the spirals onto a ramp or shelf for stacking.

In addition to operating at high speeds, present day printers are also capable of accommodating different webs of paper each having a different spacing between the transverse perforations. Depending upon the particular business form or computer sheet involved, the spacing between adjacent transverse perforations along the length of the web may vary from about 7½ inches to 18 inches or more. The folding apparatus associated with the printers must therefore also be capable of accommodating different spacings between the transverse perforations of the web. This requires adjustment of the spacing between the fingers and spirals on both the forward and rearward ends of the machine, and also an adjustment of the length of the throw, i.e., the forward and rearward reciprocating movement, of the swing chute.

In some zig-zag folding apparatus, the swing chute comprises a single pair of plates or blades which are spaced from one another to form a gap therebetween through which the paper is fed for delivery to the spiral folders. See, for example, U.S. Pat. Nos. 4,512,561 to Ury, 3,912,252 to Stephens, and 2,098,427 to Menschner. Each of the blades is pivotally mounted at opposite ends to a bracket carried by the frame of the folding apparatus such that the top of the blades is laterally fixed and the bottom swings or pivots relative to the top along an arc having a radius equal to the length of the blades.

In order for the fingers of such prior art folding apparatus with a single pair of swing chute blades to engage the paper and force it into contact with the spiral folders, the bottom of the swing chute blades must deliver the paper within a predetermined area at the end of its forward and rearward stroke. If the bottom of the swing chute blades falls short of the fingers, or delivers the paper above or below the folding area within which the fingers can engage the paper and direct it into contact with the spirals, folding of the paper is difficult if not impossible. Fixed length swing chutes are capable of only limited adjustment in the length of movement or stroke before the bottom of their blades swing to a position short of, or above or below, the folding area of the fingers at the forward and rearward end of the machine.

The problem of limited swing chute adjustment has been solved, to some extent, by the structure disclosed in U.S. Pat. Nos. 3,889,940 to Jakob; 4,045,012 to Jakob; and 4,401,428 to Thomas et al. The swing chute assembly disclose in each of these patents comprises an upper chute and a lower chute each having a pair of spaced plates or blades. As described in detail in such patents, opposite sides of the upper chute are pivotally mounted to the frame of the folder, and the lower chute is pivotally mounted to the upper chute. A drive mechanism is provided which comprises two pairs of drive arms, one pair mounted on each side of the frame. One of the drive arms of each pair is connected at approximately the midpoint of the upper swing chute and the second drive arm of each pair is mounted to the upper end of the lower swing chute. Each pair of drive arms is mounted upon and driven by eccentric cam surfaces of a common cam which is adjustable to vary the stroke or throw of the drive arm pairs depending upon the distance between adjacent perforations formed in the paper to be folded.

A swing chute assembly having both an upper chute and a lower chute substantially increases the distance or stroke through which the paper can be moved compared to those having a single pair of swing chute blades. This is because the reciprocating movement is obtained not only by the pivoting motion of the upper chute with respect to the frame, but also by pivotal movement of the lower chute with respect to the upper chute.

Although an improvement, the swing chute assemblies disclosed in the above identified patents to Jakob and Thomas et al are relatively complicated, cumbersome and difficult to adjust. The upper and lower swing chutes described in such patents are driven by two pairs of drive arms with one pair being mounted on each side of the machine frame. In order to adjust the length of throw of the swing chute assembly, each pair of drive arms must be adjusted. Furthermore, because both arms of a pair of arms are mounted upon a common eccentric cam, adjustment of its throw of one arm changes the throw of the other arm. The structure required to make such adjustment, and the provision of multiple drive arms for moving the swing chute, adds to the expense of the apparatus and complicates its operation.

Another difficulty with the swing chute assemblies of the type disclosed in the patents to Jakob and Thomas et al is that of buckling or bending of the blades which form both the upper and lower swing chutes. Such blades are formed of aluminum and at high operating speeds aluminum blades tend to buckle as they are rapidly reciprocated between the opposed sets of fingers and spiral folders. Buckling of the blades can cause them to contact and damage the fingers at both the forward and rearward end of the frame. As a result, prior art folding machines may have to be operated at speeds lower than that of the associated printers.

SUMMARY OF THE INVENTION

It is therefore among the objectives of this invention to provide a folding apparatus having a swing chute assembly whose stroke or throw is easily and efficiently adjusted over a wide range or distance, which is relatively inexpensive to manufacture, maintain, and operate and which is capable of high speed operation without interference or contact with the fingers which help fold the paper.

These objectives are accomplished in a spiral zig-zag folding apparatus having a swing chute assembly which consists of an upper swing chute pivotally mounted to a lower swing chute. Both the upper and lower swing chutes comprise two spaced plates or blades formed of a light weight core of foam material overwrapped by an outer layer of rigid composite material. The swing chute assembly is driven by a single drive arm connected to one end of the upper swing chute. The drive arm is mounted at one side of the frame to a drive shaft whose motion relative to the drive arm is adjustable to vary the throw of the drive arm, and, in turn, the throw of the swing chute to accommodate paper having transverse perforations spaced from about 7½ inches apart to about 22 inches apart.

In a presently preferred embodiment, the opposed blades of the upper chute are fixed at opposite ends to a bracket and each bracket is pivotally mounted at a fixed pivot point to one side of the frame of the folding apparatus. The blades and mounting brackets of the upper chute extend downwardly from the fixed pivot points and each are pivotally connected to brackets which carry opposite ends of the lower chute. The top of one of the mounting brackets of the lower chute is pivotally mounted to one end of a control link whose opposite end is mounted at a fixed pivot point on the side of the frame opposite the drive arm.

The single drive link, preferably formed in a one piece section, has a rearward end adjustably mounted to the drive shaft and a forward end pivotally mounted to approximately the midpoint of one of the mounting brackets of the upper chute. In response to rotation of the drive shaft, the drive arm is reciprocated forwardly and rearwardly relative to the frame. In turn, the upper chute is rotated about its fixed pivotal connection to the opposed sides of the frame. Pivotal or swinging motion of the upper chute causes the lower chute to pivot about its connection to the fixed control arm link and about its connection to the upper chute. As a result, a relatively short movement of the drive arm, and, in turn, the upper chute, produces a relatively large swing or stroke in the lower chute. In the presently preferred embodiment, the overall stroke of the swing chute assembly can be varied to accommodate spacings from about 7½ inches to about 22 inches between adjacent perforations of a given length of paper.

In the presently preferred embodiment, a dovetail connection is formed between the rearward end of the drive arm and a male connector or disc mounted to the drive shaft to permit adjustment of the axis of rotation of the drive arm with respect to the axis of rotation of the drive shaft. The drive shaft is formed with a threaded end insertable through an elongated slot formed in the rearward end of the drive arm. A nut is threaded onto the threaded end of the drive shaft to secure it in place in the desired position along the slot formed in the drive arm. The greater the offset between the axis of rotation of the drive shaft and the axis of rotation of the drive arm, the greater the length of movement or throw of the upper chute, and, in turn, the lower chute.

In a presently preferred embodiment, each of the plates or blades forming the upper and lower chutes of the swing chute assembly comprises a core formed of foam material such as polystyrene foam which is overwrapped by one or more layers of composite material such as graphite weave cloth impregnated with an epoxy matrix material. The foam core and composite outer layer are formed with a pair of spaced front and rear faces, one of which is shorter than the other to an angled edge at both the top and bottom of the blades. Preferably, the edges formed between the forward and rearward face of the blades extend at an acute angle of approximately 10° with respect to the rear face.

The angled edges of the swing chute blades enable the swing chute assembly to move closely adjacent the fingers at opposite ends of its stroke without contacting or otherwise damaging them. Additionally, the composite construction of the blades forming the swing chutes herein is much less susceptible to buckling or bending at high speeds of operation, and are much lighter, than the aluminum blades employed in the prior art. This further reduces the chance of interference between the blades and fingers and allows the folding machine to be operated at higher speeds.

DETAILED DESCRIPTION OF THE DRAWINGS

Figure 1A:
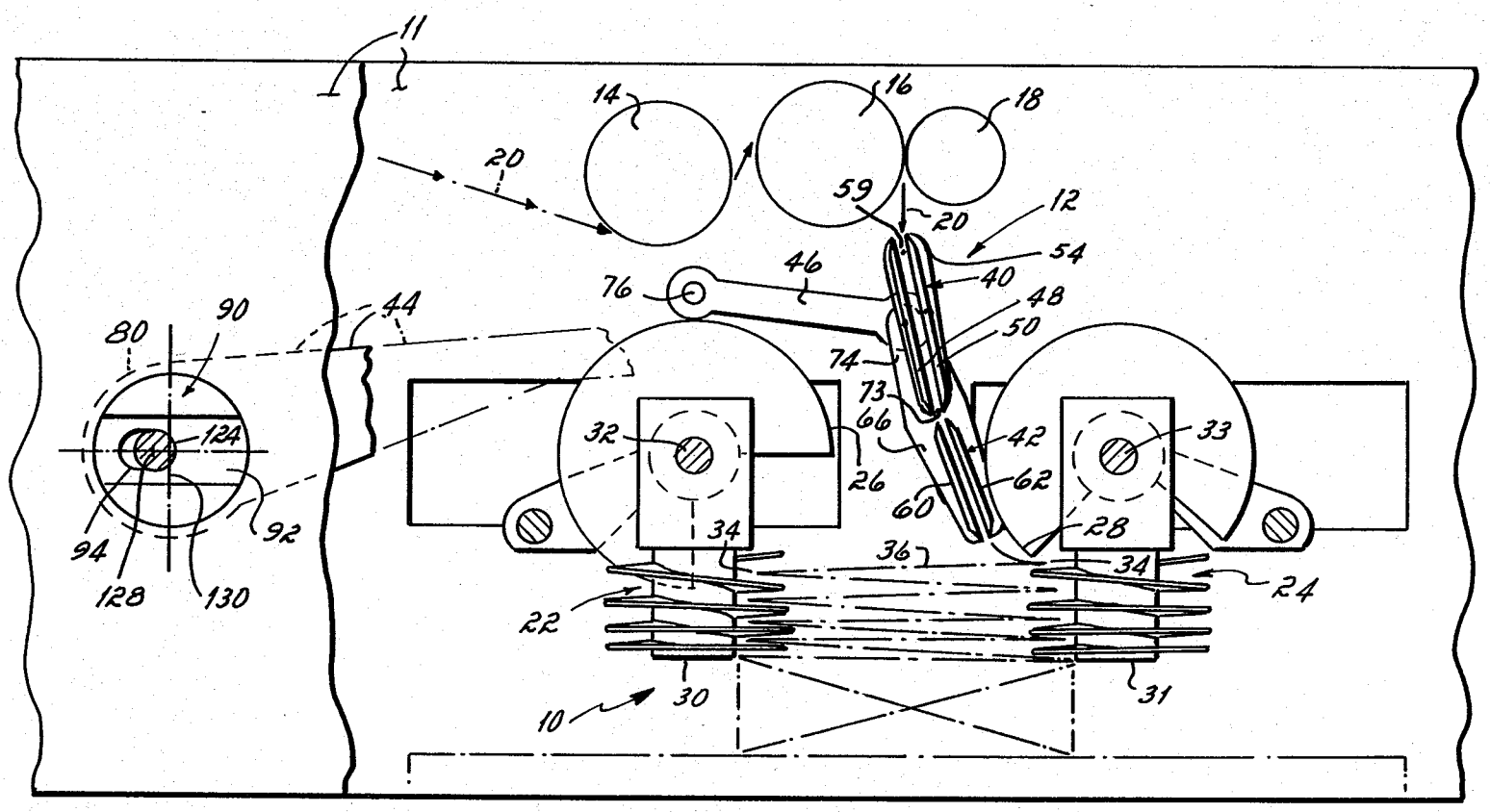
Figure 1B:
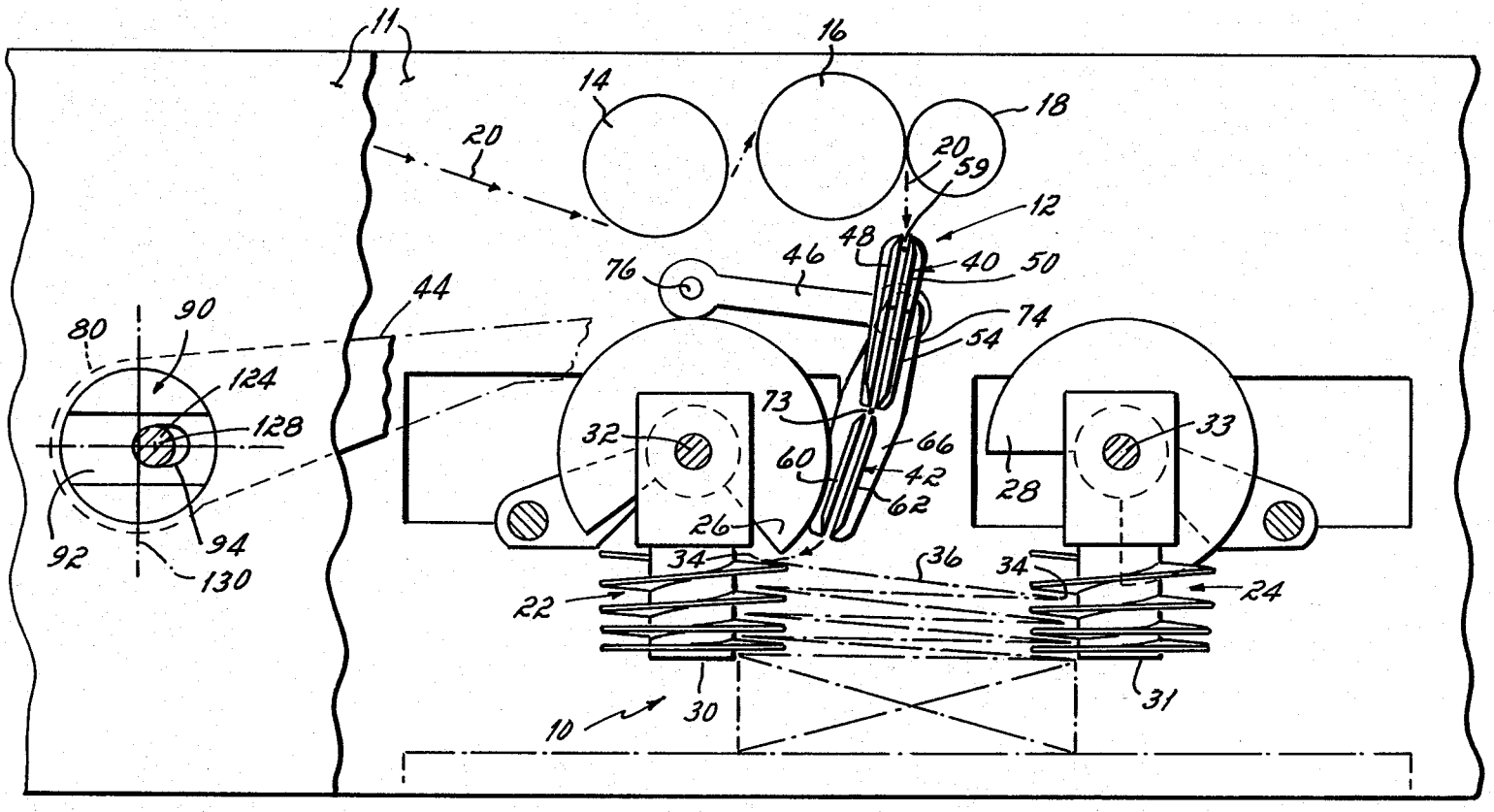
Figure 2A:
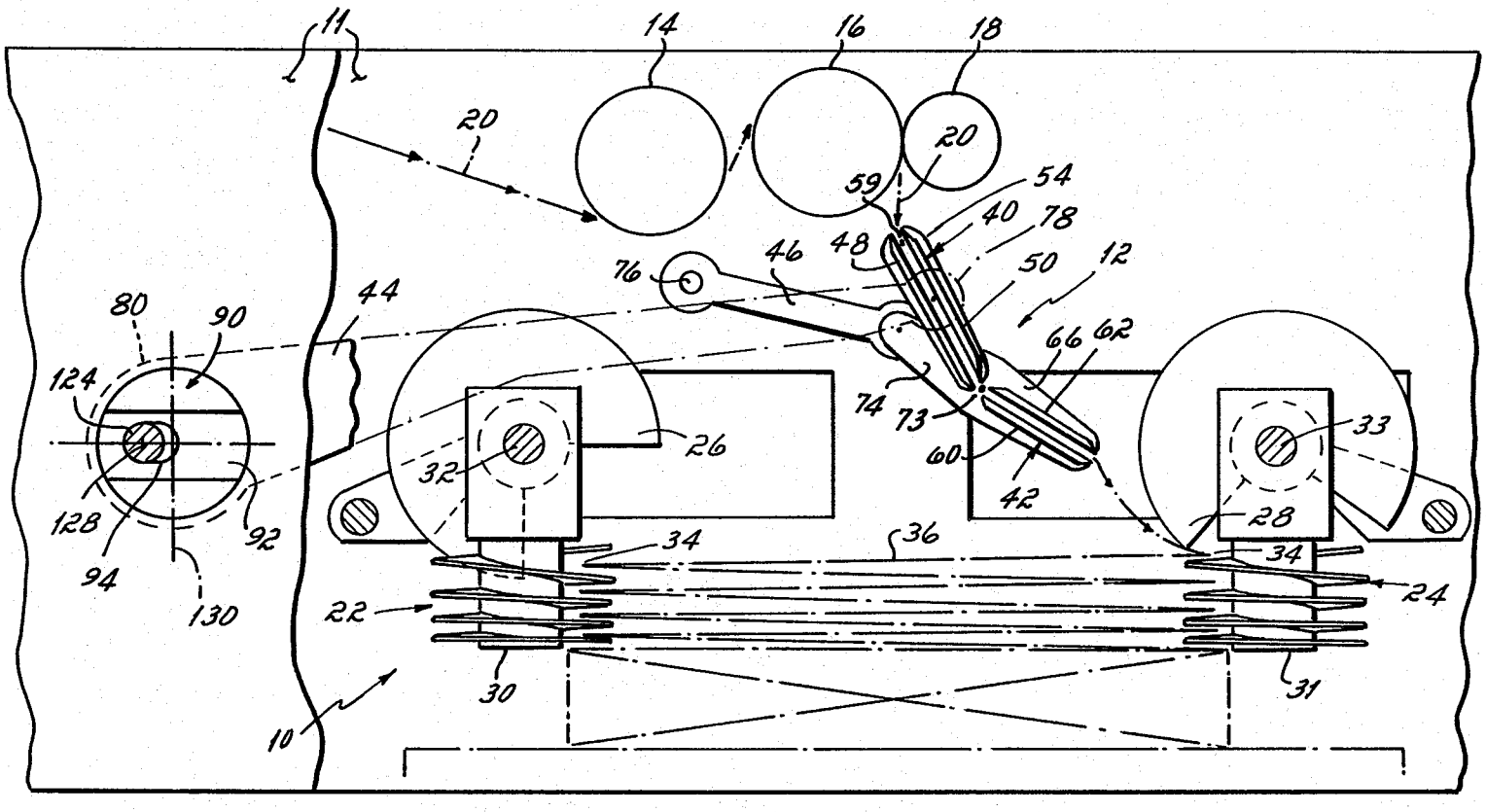
Figure 2B:
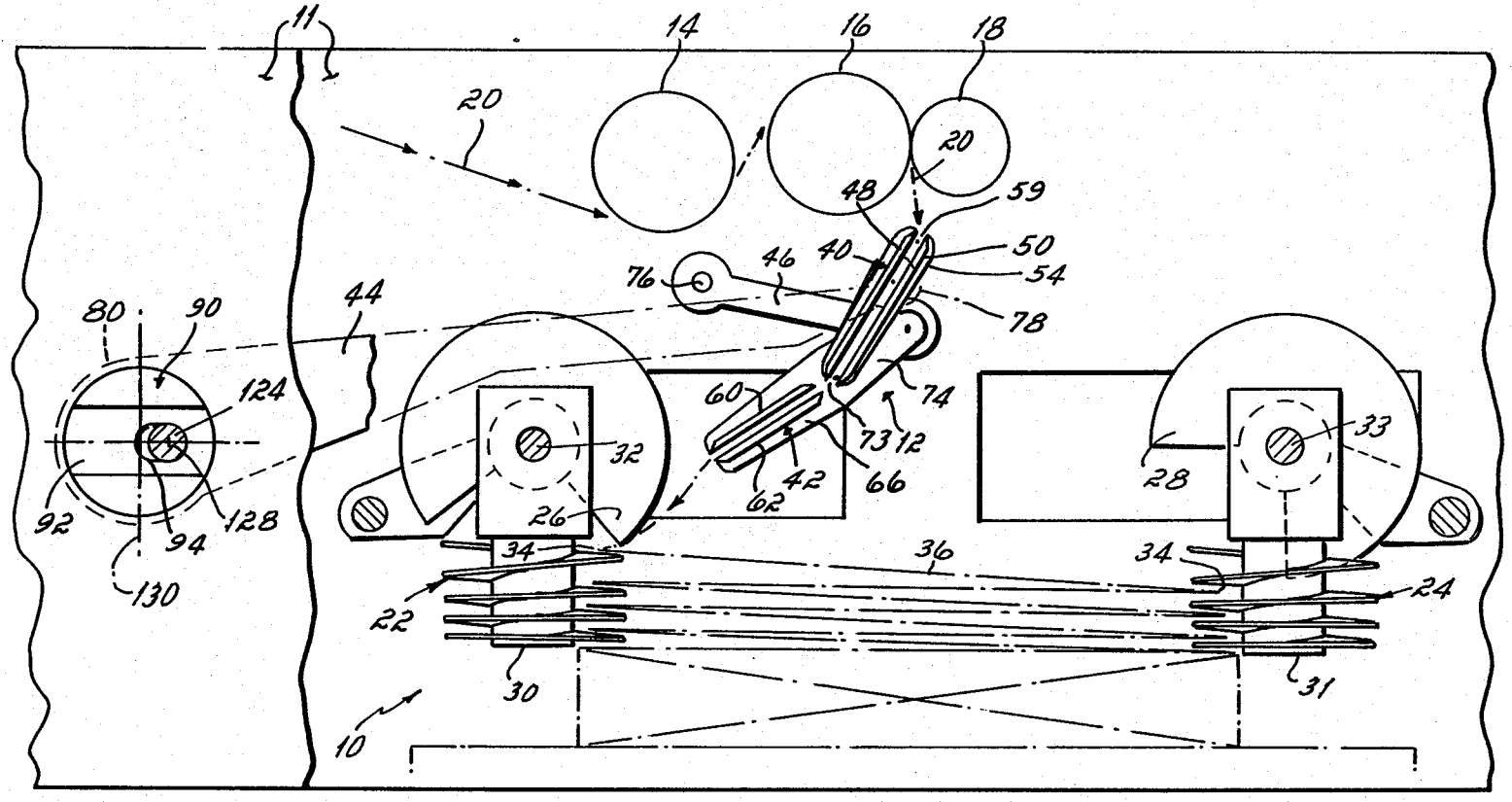
Figures 3, 4, 5:
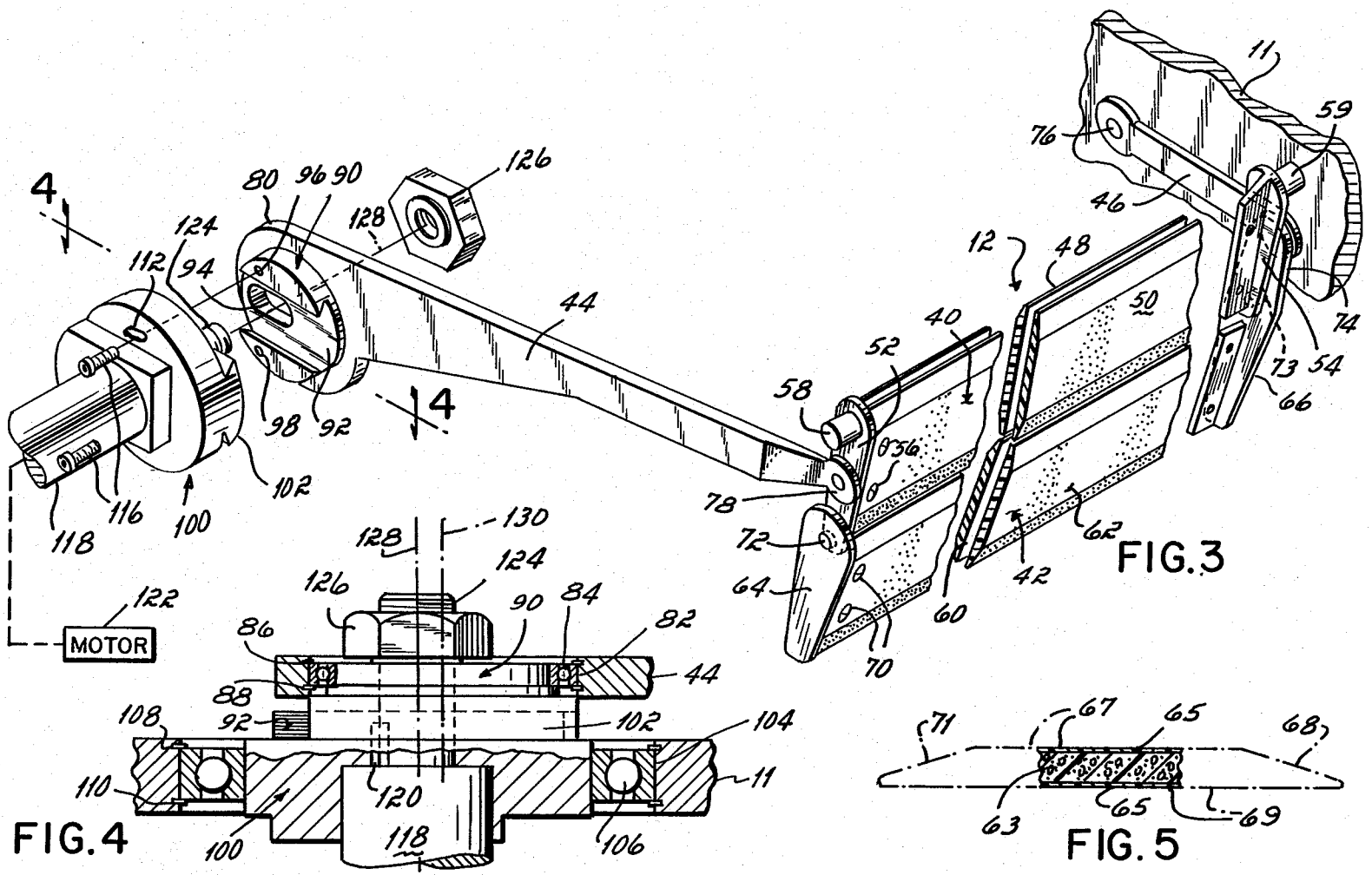

The structure, operation and advantages of a presently preferred embodiment of this invention will become further apparent upon consideration of the following description, taken in conjunction with the accompanying drawings, wherein:

FIG. 1*a* is a schematic view of a folding apparatus employing the swing chute assembly of this invention wherein the swing chute is adjusted for minimum throw and is shown at its forwardmost point of travel;

FIG. 1*b* is a view similar to FIG. 1*a* with the swing chute assembly at its rearwardmost position;

FIG. 2*a* is a view similar to FIG. 1*a* with the swing chute assembly herein adjusted for its maximum throw and is shown at its forwardmost point of travel;

FIG. 2*b* is a view similar to FIG. 2*a* with the swing chute assembly shown at its rearwardmost point of travel;

FIG. 3 is a partial perspective view of the swing chute assembly herein with the connection between the drive arm and eccentric cam shown in an unassembled, exploded relationship; and FIG. 4 is a view in partial cross-section taken generally along line 4—4 of FIG. 3. FIG. 5 is a cross-sectional view of blades 48, 50, 60 and 62.

DETAILED DESCRIPTION OF THE INVENTION

Referring now to Figs. 1*a*–2*b* schematic views of a portion of a spiral zig-zag folding apparatus 10 are shown to illustrate the environment in which the swing chute assembly 12 of this invention operates. The folding apparatus 10 includes a guide roller 14, an idler roller 16 and a drive roller 18 which receive a length of paper 20 from a web (not shown) and deliver the paper 20 to the swing chute assembly 12. As described in detail below, the swing chute assembly 12 reciprocates forwardly and rearwardly between opposed spiral folders 22 and 24 and associated beaters or fingers 26 and 28, only one pair of each being illustrated in the FIGS. For purposes of the present discussion, the direction "forward" refers to the right hand side of FIGS. 1*a*–2*b*, and the direction "rearward" refers to the left hand side of the same Figs.

The spiral folders 22, 24 are mounted on vertical shafts 30, 31, respectively, which rotate the spiral folders 22, 24 in timed relation to the reciprocating movement of swing chute assembly 12. Each of the fingers 26, 28 is mounted to a horizontal shaft 32, 33, respectively, which also are rotated in timed relation to the movement of the swing chute assembly 12. As illustrated in FIGS. 1*a* and 1*b*, for example, the swing chute assembly 12 guides the paper 20 rearwardly toward the spiral folder 22 where it is engaged by the fingers 26 and urged into contact with the spiral folder 22. The spiral folder 22 functions in a known manner to crease the paper 20 along its transversely oriented perforations, e.g., at 34, to form a fold thereat. The swing chute assembly 12 then moves forwardly toward the spiral folder 24 and fingers 28 where the folding process is repeated. In this manner, each end of an individual sheet 36 of the paper 20, between its transverse perforations 34, is folded so that a stack of individual sheets 36 is formed.

The folding apparatus 10 is also provided with structure (not shown) for adjusting the lateral position of the spiral folders 22, 24 and fingers 26, 28 along the frame 11 of the folding apparatus 10. As described below, this enables the folding apparatus 10 to accommodate paper 20 having different spacings between adjacent perforations 34 thus forming individual sheets 36 of different length. The structure for rotating the spiral folders 22, 24 and fingers 26, 28, and for adjusting their lateral position along the apparatus frame 11, forms no part of this invention per se and is thus not illustrated in detail herein.

Referring now to FIGS. 3 and 4, the swing chute assembly 12 of this invention is illustrated in more detail. The swing chute assembly comprises an upper chute 40, a lower chute 42, a single drive arm 44 and a control arm 46 which cooperate to reciprocate the paper 20 between the spiral folders 22, 24.

The upper chute 40 comprises a pair of opposed plates or blades 48, 50 each mounted at one end to a bracket 52 and at the opposite end to a bracket 54 by screws 56. The top of each bracket 52, 54 is formed with a rod 58, 59, respectively, which are pivotally mounted to opposite sides of the frame 11 of apparatus 10.

The lower chute 42 comprises two spaced plates or blades 60, 62 each of which are mounted at one end to a bracket 64 and at the opposite end to a bracket 66 by screws 70. The bottom of the upper chute brackets 52, 54 are pivotally mounted by pins 72, 73 at approximately the midpoint of the lower chute brackets 64, 66, respectively. The lower chute 42 is therefore pivotal with respect to the upper chute 40 for purposes to become apparent below.

In a presently preferred embodiment shown in FIG. 5, the blades 48, 50 of the upper chute 40 and the blades 60, 62 of the lower chute 42 comprise a core 63 formed of a foam material such as polystyrene foam, overwrapped with one or more outer layers 65 of composite material such as graphite cloth impregnated with an epoxy matrix material. The blades 48, 50, 60, 62 are each formed with a front or outer face 67 and a back or inner face 69. The outer face 69 is shorter than the inner face 67 to form angled top and bottom edges 68, 71 therebetween. Preferably, an acute angle of approximately 10° is formed between each of the angled edges 68, 71, and the inner face 69 of each blade 48, 50, 60, 62.

An arm 74 of lower chute bracket 66 extends above bracket pivot 73. This arm is pivotally mounted at its top to one end of the control arm 46. The opposite end of control arm 46 is mounted at a fixed pivot 76 to one side of the frame 11 of folding apparatus 10. The end of the control arm 46 mounted to bracket 66 is therefore free to swing or pivot about pivot 76 upwardly and downwardly with the motion generated by the arm 74 as it pivots about lower chute pivot 73, but is maintained in a fixed lateral position with respect to the frame 11 by the fixed pivot 76.

Referring now to the left hand portion of FIG. 3, and to FIG. 4, the drive arm 44 is formed in a one piece section carried on one side of the frame 11. The forward end 78 of the drive arm 44 is pivotally mounted at approximately the midpoint of bracket 52 of the upper chute 40. The rearward end 80 of the drive arm 44 is partially circular in cross section and is formed with a throughbore 82. A bearing 84 is mounted by snap rings 86, 88 within the throughbore 82 and carries a female connector 90 in the form of a stepped disc. A portion of the female connector 90 extends outwardly from the face of drive arm 44 and such portion is formed with a slot or mortise 92 extending horizontally along its entire length. An elongated slot 94 extends through the female connector 90 within the mortise 92. The outermost face of the female connector 90, on either side of the mortise 92, is formed with a pair of threaded bores 96, 98.

The female connector 90 is adapted to mate with a male connector 100 in the form of an disc having an extension or tenon 102 adapted to mate with the mortise 92 of the female connector 90 to form a dovetail joint. As shown in FIG. 4, one side of the frame 11 is formed with a throughbore 104 within which a bearing 106 is supported by snap rings 108, 110. The male connector 100 is carried on the frame 11 by the bearing 106 for rotation relative thereto. Elongated slots 112 are formed at the top and bottom of the male connector 100, only one of which is shown, which receive a mounting screw 116.

A drive shaft 118 is connected to the male connector 100 by a key 120. As illustrated schematically in FIG. 3, the drive shaft 118 is rotated by a motor 122, which, in turn, rotates the male connector 100. A threaded portion 124 of drive shaft 118 extends through the male connector 100 and is adapted to be received within the elongated slot 94 in the female connector 90. When assembled, as shown in FIG. 4, the tenon 102 of the male connector 100 is received within the mortise 92 of the female connector 90. In this position, the elongated slots 112 of the male connector 100 align with the threaded bores 96, 98, respectively, of the female connector 90 to receive mounting screws 116. Additionally, the threaded portion 124 of the drive shaft 118 extends through the elongated slot 94 and receives a nut 126 which is tightened against the female connector 90.

As shown in FIG. 4, the axis of rotation of male connector 100 or drive axis of rotation 128 is co-linear with the longitudinal axis of the drive shaft 118. The axis of rotation of the drive arm 44 is co-linear with the longitudinal axis of the female connector 90 carried by the bearing 84. When mounted to the male connector 100, the female connector 92 effectively becomes an adjustable eccentric cam lobe wherein the axis of rotation of the female connector 92, or eccentric axis 130, is offset relative to the drive axis of rotation 128. As a result, upon rotation of the drive shaft 118 and male connector 100 the drive arm 44 is moved laterally, i.e., forwardly and rearwardly, with respect to the frame 11 by the eccentrically mounted female connector 92.

The amount of offset between the drive axis of rotation 128 and eccentrically positioned axis of rotation 130 determines the distance of the forward and rearward movement, or stroke, of drive arm 44. This distance or spacing between the axes of rotation 128, 130 is easily varied by loosening nut 126 and mounting screws 116, sliding the tenon 102 of male connector 100 laterally within the mortise 92 of female connector 90 and then retightening the nut 126 and mounting screws 116.

For example, reference is made to FIGS. 1*a* and 1*b* for a discussion of the stroke of drive arm 44 obtained with a minimum spacing between the axes 128, 130. In these FIGS., the position of the eccentrically mounted female connector 90 is adjusted relative to the male connector 100 so that the threaded portion 124 of drive shaft 118 is at the forwardmost edge of elongated slot 94 in the female connector 90 as viewed in FIG. 1*a*. This places the drive axis of rotation 128 as close as possible to the eccentrically positioned axis of rotation 130 of drive arm 44 and moves the drive arm 44, and swing chute assembly 12, in their forwardmost position wherein the lower chute 42 is adjacent the forward fingers 28 and spirals 24.

In response to 180° rotation of the male connector 100, the axis of rotation 130 shifts 180° to a rearward position relative to the drive axis of rotation 128 of drive shaft 118 as shown in FIG. 1*b*. In turn, this movement reciprocates the drive arm 44 from its forwardmost position shown in FIG. 1*a* and its rearwardmost position shown in FIG. 1*b*. Because the eccentric axis of rotation 130 is in its closest position relative to the drive axis of rotation 128 in FIGS. 1*a* and 1*b* the extent of motion or stroke of the drive arm 44 is shortest. This, in turn, moves the swing chute assembly 12 the shortest distance between spiral folders 22, 24 and fingers 26, 28 to accommodate paper 20 having transverse perforations 34 spaced approximately 7½ inches apart.

As shown in FIGS. 1*a* and 1*b*, the lower chute 42 of swing chute assembly 12 is pivoted a relatively large distance in response to a relatively short movement or stroke of the drive arm 44. As the drive arm 44 moves rearwardly, the upper chute 40 is pivoted about the rods 58, 59 at its opposed ends. Since the bottom of each bracket 52, 54 of the upper chute 40 is pivotally connected to approximately the midpoint of bracket 66 of lower chute 42, the lower chute is also driven rearwardly with the rearward motion of the upper chute 40. While moving rearwardly, the bottom portion of the lower chute 42 pivots about its connection between the arm 74 at the top of its bracket 66 and the control arm 46. This causes the lower chute 42 to swing through a longer arc than the upper chute 40 so that the bottom of the lower chute 42 moves closely adjacent both the rearward spiral folder 22 and forward spiral folder 24.

Referring now to FIGS. 2*a* and 2*b*, the drive arm 44 is adjusted to provide maximum throw of the swing chute assembly 12. As shown in FIG. 2*a*, the threaded portion 124 of drive shaft 118 is positioned at the rearwardmost edge of the elongated slot 94 in female connector 90 where it is fixed in place as described above. In this position, the drive axis of rotation 128 is spaced the furthest distance from the eccentrically positioned axis of rotation 130 of the drive arm 44.

In FIG. 2*a*, the drive arm 44 is moved to its forwardmost point of travel wherein the eccentric axis of rotation 130 is spaced forwardly of the drive arm axis of rotation 128. In turn, the upper chute 40 and lower chute 42 are moved by the drive arm 44 to their forwardmost position with respect to the spiral folder 22 and fingers 26. Rotation of the drive shaft 118 to the position shown in FIG. 2*b*, i.e., approximately 180°, places the eccentric axis of rotation 130 rearwardly of the drive axis of rotation 128. This moves the drive arm 44 a maximum distance rearwardly and pivots the upper and lower chutes 40, 42 rearwardly so that the bottom of the lower chute 42 moves adjacent to the rearward spiral folder 22 and fingers 26.

Adjustment of the extent of motion or stroke of the drive arm 44 and swing chute assembly 12 is therefore accomplished by a single adjustment of the position of the female connector 90 with respect to the male connector 100. The eccentrically positioned axis of rotation 130 of drive arm 44 is moved the desired distance from the axis of rotation 128 so that the resulting movement of the swing chute assembly 12 can be varied from about 7½ inches to about 22 inches.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. Apparatus for zig-zag folding of a length of paper having longitudinally spaced transversely oriented perforations, comprising:

a frame having a first side, a second side, a forward end and a rearward end, said frame mounting a spiral folder at said forward end and at said rearward end thereof;

a swing chute assembly having an upper chute and a lower chute each adapted to receive and guide the paper between said opposed spiral folders, said upper chute being pivotally mounted to said first side and said second side of said frame, said lower chute being pivotally mounted to said upper chute;

drive means for reciprocating said swing chute assembly in a forward and rearward direction between said opposed spiral folders, comprising:

(i) a single drive arm pivotally mounted to said first side of said frame and connected to said upper chute of said swing chute assembly;

(ii) a single control arm pivotally mounted at one end to said second side of said frame and laterally fixed in a forward and rearward direction to said frame, the other end of said single control arm being pivotally mounted to said lower chute of said swing chute assembly;

(iii) means for moving said single drive arm forwardly and rearwardly relative to said frame to reciprocate said upper chute, aid lower chute being pivoted in response to said reciprocating movement of said upper chute so that the paper is moved between said opposed spiral folders for folding.

2. The apparatus of claim 1 in which said single drive arm is connected at approximately the midpoint of one end of said upper chute of said swing chute assembly.

3. The apparatus of claim 1 in which said lower chute of said swing chute assembly has a top, a bottom and opposed ends, said single control arm being connected to one of said opposed ends of said lower chute near said top thereof.

4. The apparatus of claim 1 in which said swing chute assembly comprises:

an upper chute having a pair of opposed blades each mounted at one end to a bracket, said opposed blades each including a core formed of foam material and at least one outer layer formed of composite material;

a lower chute having a pair of opposed blades each mounted at one end to a bracket, said brackets of said lower chute being pivotally mounted to said brackets of said upper chute, said opposed blades of said lower chute each including a core formed of foam material and at least one outer layer formed of composite material.

5. The apparatus of claim 4 in which said core is formed of polystyrene foam material.

6. The apparatus of claim 4 in which said outer layer is formed of graphite weave cloth impregnated with an epoxy matrix material.

7. Apparatus for zig-zag folding of a length of paper having longitudinally spaced, transversely oriented perforations, comprising:

a frame having a first side, a second side, a forward end and a rearward end;

opposed spiral folders rotatably mounted to said frame, said spiral folders being operable to fold the paper along its transverse perforations;

opposed fingers associated with each of said spiral folders for urging the paper into contact with said spiral folders for folding;

a swing chute assembly having an upper chute and a lower chute each adapted to receive and guide the paper between said opposed spiral folders and fingers, said upper chute being pivotally mounted to said first and said second side of said frame, said lower chute being pivotally mounted to said upper chute;

drive means for reciprocating said swing chute assembly in a forward and rearward direction between said opposed spiral folders and fingers, comprsiing:

(i) a single drive arm pivotally mounted to said first side of said frame and connected to said upper chute of said swing chute assembly;

(ii) a single control arm pivotally mounted at one end to said second side of aid frame and laterally fixed in a forward and rearward direction to said frame, the other end of said single control arm being pivotally mounted to said lower chute of said swing chute assembly;

(iii) means for moving said single drive arm forwardly and rearwardly relative to said frame to reciprocate said upper chute said lower chute being pivoted in response to said reciprocating movement of said upper chute to guide the paper to said opposed fingers and said opposed spiral folders for folding.

8. The apparatus of claim 7 in which said means for moving said single drive arm comprises:

a motor driven shaft;

a male connector including a disc formed with an extension in the shape of a tenon carried at one end of said shaft, said male connector having an axis of rotation;

a female connector including a mortise formed on one end of said single drive arm, said mortise of said female connector being mateable with said tenon of said male connector to form a dovetail joint connection between said shaft and said single drive arm, said female connector having an axis of rotation;

adjustment means for mounting said female connector to said male connector so that said axis of rotation of said male connector is laterally offset from said axis of rotation of said female connector, said adjustment means being effective to adjust the lateral position of said male connector relative to said female connector to vary said lateral offset between their axes of rotation.

9. The apparatus of claim 8 in which said single drive arm is connected at approximately the midpoint of one end of said upper chute of said swing chute assembly.

10. The apparatus of claim 8 in which said lower chute of said swing chute assembly has a top, a bottom and opposed ends, said control arm being connected to one of said opposed ends of said lower chute near said top thereof.

11. The apparatus of claim 8 in which said swing chute assembly comprises:

an upper chute having a pair of opposed blades each mounted at one end to a bracket, said opposed blades each including a core formed of foam material and at least one outer layer formed of composite material;

a lower chute having a pair of opposed blades each mounted at one end to a bracket, said brackets of said lower chute being pivotally mounted to said brackets of said upper chute, said opposed blades of said lower chute each including a core formed of foam material and at least one outer layer formed of composite material.

12. The apparatus of claim 11 in which said core is formed of polystyrene foam material.

13. The apparatus of claim 11 in which said outer layer is formed of graphite weave cloth impregnated with an epoxy matrix material.

* * * * *